US009598811B2

(12) United States Patent
Lee et al.

(10) Patent No.: US 9,598,811 B2
(45) Date of Patent: Mar. 21, 2017

(54) WASHING MACHINE

(71) Applicant: SAMSUNG ELECTRONICS CO., LTD., Suwon-si, Gyeonggi-do (KR)

(72) Inventors: Do Yun Lee, Yongin-si (KR); Jong Su Jeon, Seongnam-si (KR); Jung Hwan Kim, Seoul (KR); Hong Seok Ko, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 76 days.

(21) Appl. No.: 14/520,986

(22) Filed: Oct. 22, 2014

(65) Prior Publication Data

US 2015/0123521 A1 May 7, 2015

(30) Foreign Application Priority Data

Nov. 5, 2013 (KR) ..... 10-2013-0133729
Feb. 7, 2014 (KR) ..... 10-2014-0014150

(51) Int. Cl.
*D06F 39/14* (2006.01)
*D06F 39/12* (2006.01)
*D06F 37/28* (2006.01)

(52) U.S. Cl.
CPC ..... *D06F 39/14* (2013.01); *D06F 37/28* (2013.01); *D06F 39/12* (2013.01)

(58) Field of Classification Search
CPC ..... D06F 39/14; D06F 37/28; D06F 39/12; D06F 37/42; Y10S 292/69; Y10S 292/11; A47L 15/4259
USPC ..... 312/228, 328; 68/12.26; 292/DIG. 69, 292/DIG. 11
See application file for complete search history.

(56) References Cited

U.S. PATENT DOCUMENTS 4,262,945 A * 4/1981 Paulson ..... D06F 37/42 292/89
4,914,781 A * 4/1990 Sokn ..... D06F 39/14 16/225
5,412,825 A * 5/1995 Moon ..... D06F 37/42 68/12.26
5,823,017 A * 10/1998 Hapke ..... D06F 37/42 210/146
6,282,927 B1 * 9/2001 Wunderlich ..... D06F 39/14 312/228

(Continued)

FOREIGN PATENT DOCUMENTS

EP 1266993 12/2002
EP 1925705 5/2008

OTHER PUBLICATIONS

Extended European Search Report dated Apr. 23, 2015 from European Patent Application No. 14191168.5, 4 pages.

*Primary Examiner* — Daniel J Troy
*Assistant Examiner* — Hiwot Tefera
(74) *Attorney, Agent, or Firm* — Staas & Halsey LLP

(57) ABSTRACT

A washing machine includes a cabinet having an opening, a door to open and close the opening, and a locking unit to selectively restrict an operation of the door when the door is closed. A position of the door is adjusted through this configuration to stably close the opening and to prevent the door from being undesirably opened, and thus it is possible to improve washing efficiency. Further, a front structure of the opening may be improved, and thus laundry may be easily put in or taken out.

21 Claims, 8 Drawing Sheets

(56) References Cited

U.S. PATENT DOCUMENTS

| | | | | |
|---|---|---|---|---|
| 6,363,755 | B1 * | 4/2002 | Hapke | D06F 37/42 210/146 |
| 7,150,480 | B2 * | 12/2006 | Lafrenz | D06F 39/12 292/201 |
| 7,154,058 | B2 * | 12/2006 | Kim | D06F 37/28 200/302.1 |
| 7,234,739 | B2 * | 6/2007 | Saitoh | E05C 19/163 292/251.5 |
| 7,251,961 | B2 * | 8/2007 | Hapke | D06F 39/14 68/12.26 |
| 8,736,406 | B2 * | 5/2014 | Hapke | D06F 37/42 292/251.5 |
| 2004/0104582 | A1 * | 6/2004 | Hwang | D06F 39/14 292/121 |
| 2006/0005997 | A1 * | 1/2006 | Kim | D06F 37/28 174/267 |
| 2006/0288742 | A1 * | 12/2006 | Hapke | D06F 39/14 68/12.26 |
| 2008/0099314 | A1 * | 5/2008 | Krieger | D06F 39/14 200/61.64 |
| 2011/0050059 | A1 * | 3/2011 | Kim | D06F 23/04 312/228 |
| 2011/0296630 | A1 | 12/2011 | Frazer et al. | |
| 2012/0279261 | A1 * | 11/2012 | Ka | D06F 39/14 68/12.04 |
| 2015/0021929 | A1 * | 1/2015 | Osvatic | D06F 39/14 292/144 |
| 2015/0240527 | A1 * | 8/2015 | Osvatic | D06F 37/42 292/144 |

* cited by examiner

WASHING MACHINE

CROSS-REFERENCE TO RELATED APPLICATIONS

This application claims the benefit of Korean Patent Application Nos. 10-2013-0133729 and 10-2014-0014150, filed on Nov. 5, 2013 and Feb. 7, 2014, respectively, in the Korean Intellectual Property Office, the disclosures of which are incorporated herein by reference.

BACKGROUND

1. Field

Embodiments disclosed herein relate to a washing machine, and more particularly to a washing machine in which a door locking structure is improved.

2. Description of the Related Art

In general, washing machines refer to apparatuses for washing laundry using water and detergent, and may include a cabinet, a fixed tub configured to (suitable for, capable of, adapted to, arranged to, operable to, etc.) store washing water, and a rotating tub rotatably disposed in the fixed tub.

The washing machine may include an opening through which the laundry is put in or taken out, and the opening is closed and opened by a door. At this time, to prevent undesirable movement of the door when opening or closing the opening, a locking unit may be provided at the door.

However, if the locking unit of the door is disposed at a front surface of the door, the cabinet corresponding to this has a protruding structure. Therefore, when a user leans to put the laundry in or take the laundry out, the user may be inconveniently disturbed by the protruding structure.

SUMMARY

Therefore, it is an aspect of the disclosure to provide a washing machine in which a structure of a door locking unit is improved.

It is another aspect of the disclosure to provide a washing machine in which a cabinet structure is improved so that a user may easily access an interior of the washing machine through the opening.

Additional aspects of the disclosure will be set forth in part in the description which follows and, in part, will be apparent from the description, or may be learned by practice of the disclosure.

In accordance with an aspect of the disclosure, a washing machine may include a cabinet having an opening and an opening flange formed around the opening, a door rotatably provided to open and close the opening, a fixed tub provided in the cabinet to store washing water, a rotating tub rotatably provided in the fixed tub, and at least one pair of locking units provided to correspond to both side surfaces of the door and to selectively restrict an operation of the door when the door is closed, wherein the opening flange may include a front flange disposed between the pair of locking units at a front side of the opening so that one side of the door is mounted thereon.

The opening flange may include a pair of side flanges formed at side surfaces of the opening to face each other, and a rear flange provided at an opposite side to the front flange and connected with the pair of the side flanges, and the front flange may be formed to have a gentler (shallower or smaller) slope than those of the side flanges and the rear flange.

The front flange may include a front inclined surface inclined downward toward a front side of the cabinet, a rear inclined surface inclined downward toward the opening, and a door mounting portion formed between the front inclined surface and the rear inclined surface so that one side of the door is mounted thereon when the door is closed.

Assuming that an angle between the side flange and a bottom surface is a side angle, an angle between the front inclined surface and the bottom surface may be formed to have a smaller front angle than the side angle.

At least one of the front inclined surface, the rear inclined surface, and the door mounting portion may be formed in or as a curved surface.

An upper portion of the opening flange may be formed to be inclined downward from a rear thereof toward a front thereof.

The cabinet may include a lower frame in which the rotating tub and the fixed tub are disposed, and an upper frame disposed on the lower frame to have the opening and the opening flange, and in the opening flange, assuming that a height from a bottom surface of the upper frame to the front flange is h1, the height h1 may be formed to be lower than a height h2 which is a height from the bottom surface to an upper portion of the side flange.

The locking unit may restrict the door at the side surface of the door when the door is in contact with the door mounting portion.

The front flange may be disposed to be lower than at least one locking unit.

At least one locking unit may include a mounting protrusion disposed at the cabinet to be mounted in a concave mounting groove which is provided at the side surface of the door, and a sliding member disposed at the cabinet to be selectively inserted into a concave fixing groove provided at the side surface of the door.

When the door is rotated around a first shaft to open and close the opening, the sliding member may be slid along a second shaft parallel to the first shaft to be inserted into the fixing groove.

In accordance with an aspect of the disclosure, a washing machine may include a cabinet having an opening, a door configured to (suitable for, capable of, adapted to, arranged to, operable to, etc.) open and close the opening, a fixed tub provided in the cabinet to store washing water, a rotating tub rotatably provided in the fixed tub, and a locking unit configured to (suitable for, capable of, adapted to, arranged to, operable to, etc.) selectively restrict an operation of the door when the door is closed, wherein the locking unit may include a mounting protrusion disposed at the cabinet to be mounted in a concave mounting groove which is provided at a side surface of the door, and a sliding member disposed at the cabinet to be selectively inserted into a concave fixing groove provided at the side surface of the door.

The sliding member may be inserted into the fixing groove when the door opens and closes the opening.

The locking unit may be disposed at the cabinet and provided as a pair of locking units to correspond to both side surfaces of the door.

Assuming that a lengthwise direction of the door corresponding to a radial direction with respect to rotation of the door is a first direction, the mounting protrusion may extend longitudinally in the first direction to correspond to the mounting groove.

Assuming that a lengthwise direction of the door corresponding to a radial direction with respect to rotation of the door is a first direction, the sliding member may extend longitudinally in the first direction to correspond to the fixing groove.

The sliding member may be provided on the mounting protrusion.

The locking unit may further include a door opening and closing detection sensor disposed at the cabinet to correspond to one or more of the side surfaces of the door and may be configured to (suitable for, capable of, adapted to, arranged to, operable to, etc.) detect opening and closing of the door.

When the door is rotated around a first shaft to open and close the opening, the sliding member may be slid along a second shaft parallel to the first shaft to be inserted into the fixing groove.

The cabinet may include an opening flange formed around the opening so that a slope thereof is gradually changed from a side of the opening toward a front side thereof in a circumferential direction of the opening.

In accordance with an aspect of the disclosure, a washing machine may include a cabinet having an opening and an opening flange formed around the opening, a door configured to (suitable for, capable of, adapted to, arranged to, operable to, etc.) open and close the opening, a fixed tub provided in the cabinet to store washing water, a rotating tub rotatably provided in the fixed tub, and a locking unit provided to correspond to both side surfaces of the door and to selectively restrict an operation of the door when the door is closed, wherein the opening flange may be provided to correspond to a front surface of the door and may be formed in forward and backward directions (from front to back) as a curved surface (e.g., to have an upwardly convex curved surface).

The door may include a fixing groove formed in a side surface thereof to have a groove shape, and the locking unit may include a sliding member configured to (suitable for, capable of, adapted to, arranged to, operable to, etc.) correspond to the fixing groove and to be slid to be inserted into the fixing groove when the door closes the opening.

The door may further include a mounting groove formed to be more concave than the side surface of the door adjacent to a side surface thereof, and the locking unit may further include a mounting protrusion configured to (suitable for, capable of, adapted to, arranged to, operable to, etc.) correspond to the mounting groove and provided so that the door is mounted thereon when the door closes the opening.

When the door is rotated around a first shaft to open and close the opening, the sliding member may be slid along a second shaft parallel to the first shaft to be inserted into the fixing groove.

In accordance with an aspect of the disclosure, a washing machine may include a cabinet having an opening, a door to open and close the opening, a tub provided in the cabinet, a first locking unit disposed in the cabinet to correspond to a first side surface of the door, a second locking unit disposed in the cabinet to correspond to a second side surface of the door, opposite of the first side surface, and a front flange disposed between a front side of the cabinet and a front side of the opening and between the first locking unit and the second locking unit. The front flange may include a front portion inclined downward toward the front side of the cabinet, a rear portion inclined downward toward the front side of the opening, and a center portion formed to have an upwardly convex curved surface which connects the front portion and rear portion.

The first locking unit may include a first sliding member to protrude into a first groove disposed in the first side surface of the door, and the second locking unit may include a second sliding member to protrude into a second groove disposed in the second side surface of the door.

When the door is rotated around a first shaft to open and close the opening, at least one of the first sliding member and the second sliding member may be slid along a second shaft parallel to the first shaft to be inserted into at least one of the first groove and the second groove.

The first locking unit may include a mounting protrusion disposed at the cabinet to be mounted in a concave mounting groove which is provided at the first side surface of the door and a sliding member disposed at the cabinet to be selectively inserted into a concave fixing groove provided at the first side surface of the door, wherein the fixing groove may extend further into the first side surface of the door than the mounting groove.

The washing machine may further include a rear flange provided at an opposite side to the front flange, wherein an angle formed between a front inclined surface of the front flange and a bottom surface may be smaller than a rear angle which corresponds to an angle formed between the rear flange and the bottom surface.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
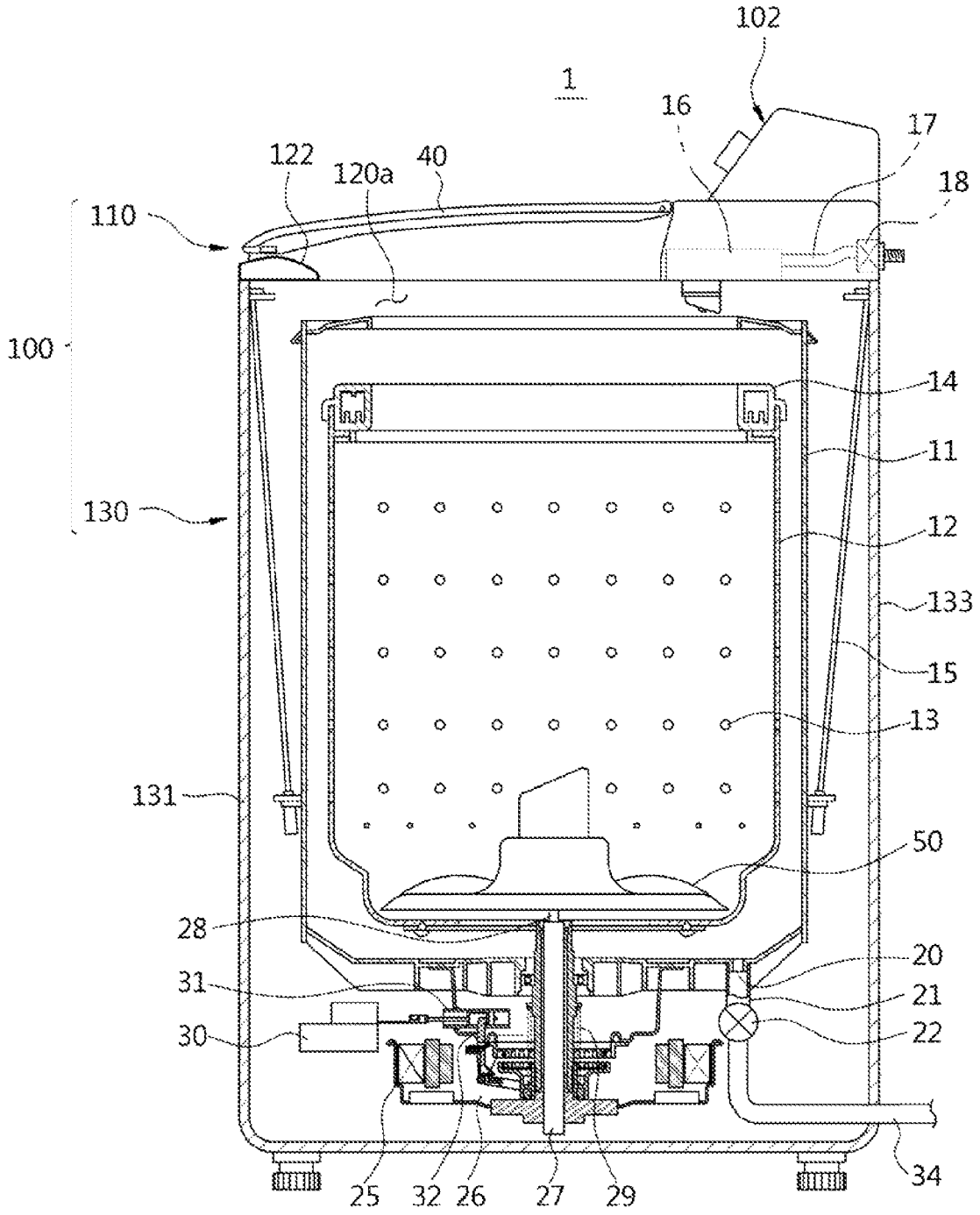
FIG. 1 is a cross-sectional view of a washing machine in accordance with an embodiment of the disclosure.

Reference will now be made in detail to embodiments, examples of which are illustrated in the accompanying drawings, wherein like reference numerals refer to like elements throughout. The example embodiments are described below to explain the disclosure by referring to the figures.

Hereinafter, embodiments of the disclosure are described in detail with reference to the accompanying drawings.

Figure 2:
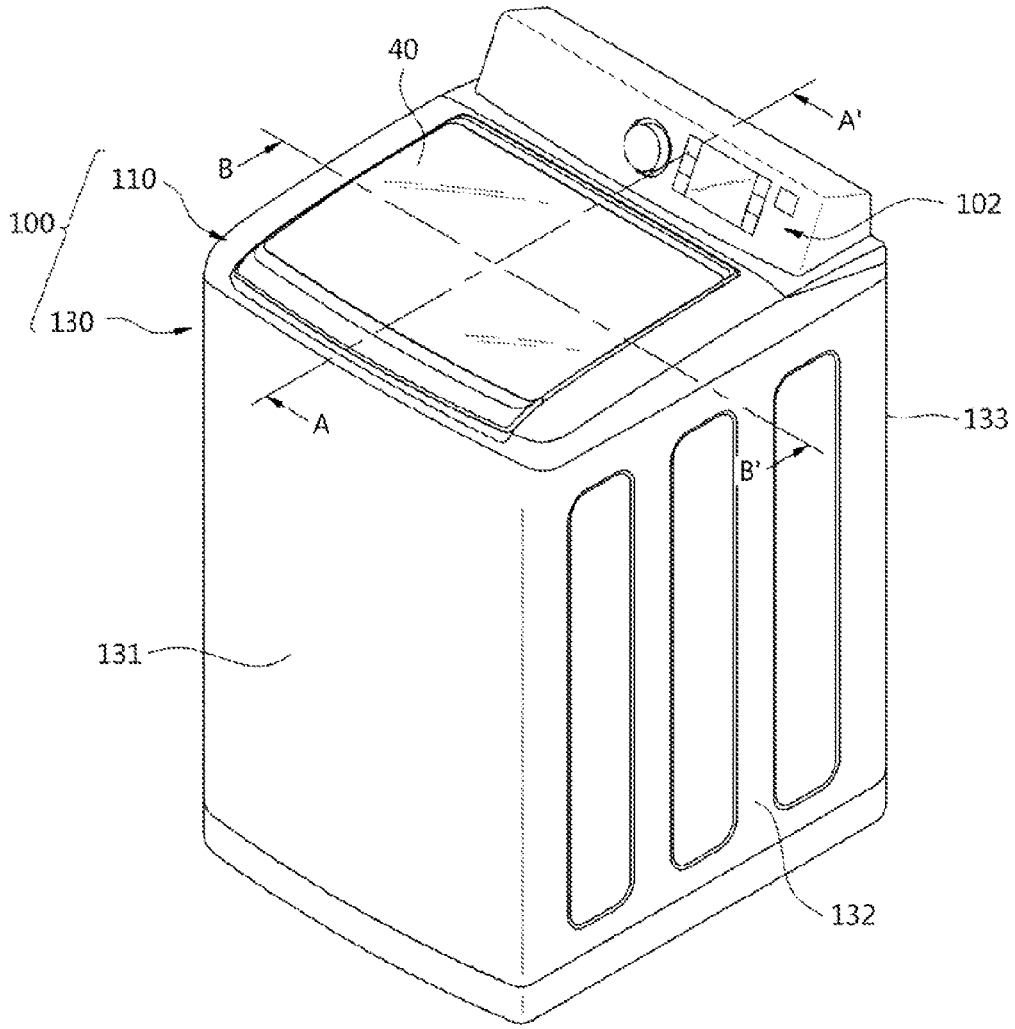
FIG. 2 is a perspective view of the washing machine in accordance with an embodiment of the disclosure.

FIG. 1 is a cross-sectional view of a washing machine in accordance with an embodiment of the disclosure, and FIG. 2 is a perspective view of the washing machine in accordance with an embodiment of the disclosure.

As illustrated in FIG. 1, a washing machine 1 may include a cabinet 100 configured to (suitable for, capable of, adapted to, arranged to, operable to, etc.) form an exterior, a fixed tub 11 disposed in the cabinet 100 to store washing water, a rotating tub 12 rotatably disposed in the fixed tub 11, and a pulsator 50 disposed in the rotating tub 12 to generate a water current.

An opening 120*a* may be formed at an upper portion of the cabinet 100 so that laundry may be put into the rotating tub 12. The opening 120*a* may be closed or opened by a door 40 installed on the cabinet 100.

The cabinet 100 may include an upper frame 110 and a lower frame 130. The lower frame 130 may include a front frame 131 provided at a front surface of the lower frame 130, a pair of side frames 132 disposed at side surfaces of the lower frame 130 to face each other and coupled with the front frame 131, and a rear frame 133 connected with the side frames 132 to face the front frame 131. The upper frame 110 may be provided on the lower frame 130 and may include the opening 120*a*.

The fixed tub 11 may be supported to the cabinet 100 through a suspension unit 15.

A water pipe 17 configured to (suitable for, capable of, adapted to, arranged to, operable to, etc.) supply the washing water to the fixed tub 11 may be installed above the fixed tub 11. One side of the water pipe 17 may be connected to an external water source, and the other side of the water pipe 17 may be connected to a detergent supplying unit 16. The water supplied through the water pipe 17 passes through the detergent supplying unit 16 and may be supplied into the fixed tub 11 together with a detergent. A water feed valve 18 may be installed at the water pipe 17 to control the water supply.

A subsidiary detergent supplying unit 104 (see, e.g., FIG. 3) may be provided at the upper frame 110. The subsidiary detergent supplying unit 104 may store a liquid detergent, bleach, fabric softener, or the like, and may supply the detergent or the like into the rotating tub 12 when a washing process is performed, thereby assisting the washing process.

The rotating tub 12 may have a cylindrical shape of which an upper portion is opened and a plurality of dewatering holes 113 may be formed in a side surface of the rotating tub 12. A balancer 14 may be installed at an upper portion of the rotating tub 12 so that the rotating tub 12 is stably rotated when the rotating tub 12 is rotated at a high speed.

A motor 25 may be configured to (suitable for, capable of, adapted to, arranged to, operable to, etc.) generate a driving force rotating the rotating tub 12 and the pulsator 50, and a power switch unit 26 may be configured to (suitable for, capable of, adapted to, arranged to, operable to, etc.) simultaneously or selectively transmit the driving force generated from the motor 25 to the rotating tub 12 and the pulsator 50. The motor 25 and the power switch unit 26 may be installed at a lower outer side of the fixed tub 11.

A hollow dewatering shaft 29 may be coupled to the rotating tub 12, and a washing shaft 27 installed in a hollow portion of the dewatering shaft 29 may be coupled to the pulsator 50 through a washing shaft coupling part 28. The motor 25 may simultaneously or selectively transmit the driving force to the rotating tub 12 and the pulsator 50 according to an up and down movement of the power switch unit 26.

The power switch unit 26 may include an actuator 30 configured to (suitable for, capable of, adapted to, arranged to, operable to, etc.) generate a driving force for power switching, a rod part 31 configured to (suitable for, capable of, adapted to, arranged to, operable to, etc.) perform a rectilinear motion according to an operation of the actuator 30, and a clutch part 32 connected with the rod part 31 to be rotated according to an operation of the rod part 31.

A drain hole 20 may be provided at a bottom of the fixed tub 12 to discharge the washing water stored in the fixed tub 12, and a first drainpipe 21 may be connected to the drain hole 20. A drain valve 22 configured to (suitable for, capable of, adapted to, arranged to, operable to, etc.) control drainage may be installed at the first drainpipe 21. An outlet port of the drain valve 22 may be connected to a second drainpipe 34 configured to (suitable for, capable of, adapted to, arranged to, operable to, etc.) discharge the washing water to an outside.

Figure 3:
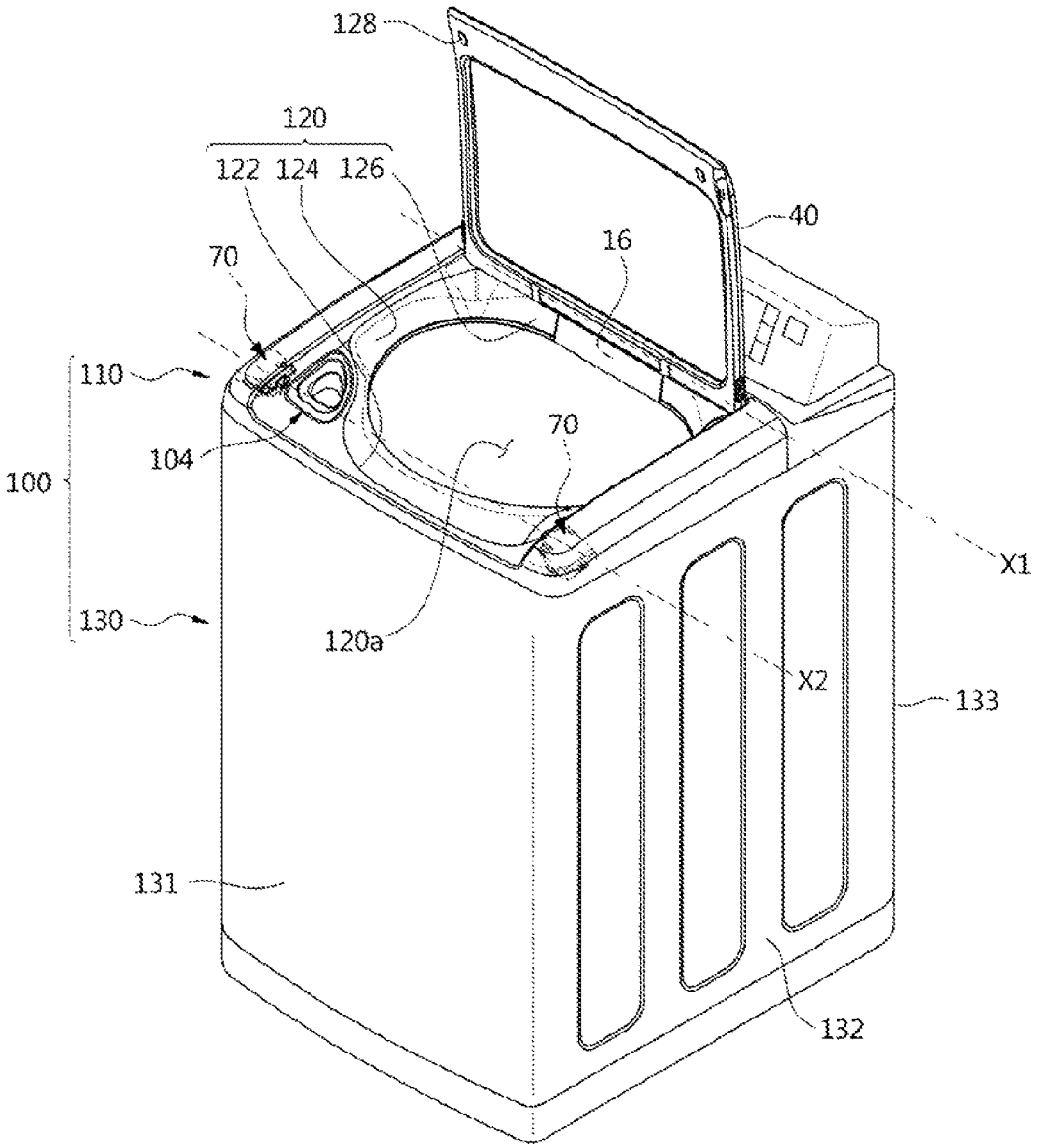
FIG. 3 is a perspective view illustrating a state in which a door of the washing machine is opened in accordance with an embodiment of the disclosure.
Figure 4:
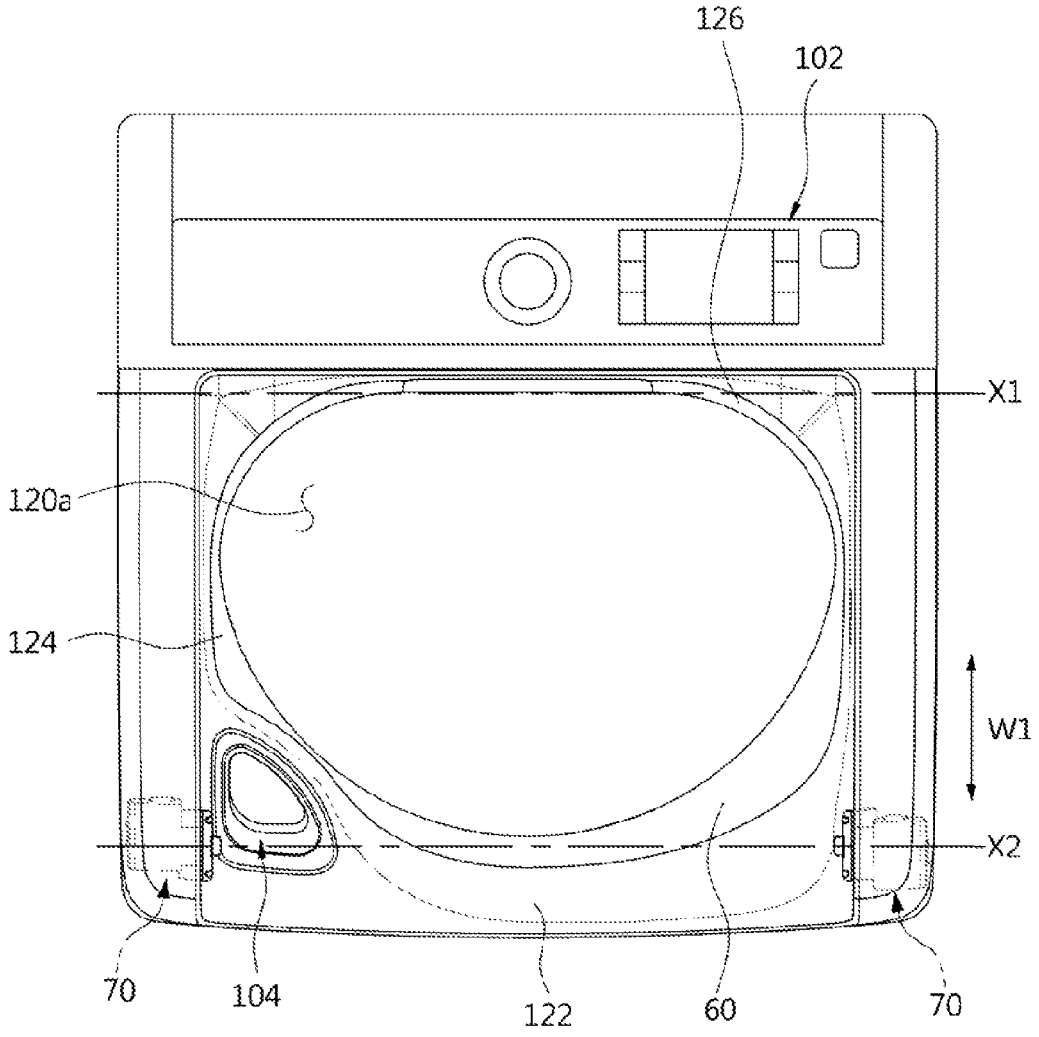
FIG. 4 is an upper front view illustrating a state in which the door of the washing machine is opened in accordance with an embodiment of the disclosure.

FIG. 3 is a perspective view illustrating a state in which the door of the washing machine is opened in accordance with an embodiment of the disclosure, and FIG. 4 is an upper front view illustrating a state in which the door of the washing machine is opened in accordance with an embodiment of the disclosure.

The washing machine may include a locking unit 70 to selectively restrict the door 40. The door 40 may be disposed to be rotatable around a rotational shaft and thus to open or close the opening 120*a*. When the door 40 closes the opening 120*a*, the locking unit 70 may control and restrict a position of the door 40.

The locking unit 70 may be disposed at the cabinet 100 to correspond to at least one of both side surfaces of the door 40. In an embodiment of the disclosure, one pair of locking units may be disposed to correspond to the both side surfaces of the door 40. Since the locking unit 70 may be disposed at the cabinet 100 to restrict the both side surfaces of the door 40, one side of the door 40 is prevented from being opened from the opening 120*a*, and thus the opening 120*a* may be stably closed. Specifically, the locking unit may be disposed at the upper frame 110 of the cabinet 100. As shown in FIG. 3 for example, the door 40 may rotate about a rotation shaft which may be disposed in an X1 direction. From a viewpoint of a user or observer facing the washing machine, a first locking unit may be disposed near an upper front left corner of the cabinet, and a second locking unit may be disposed near an upper front right corner of the cabinet. That is, the first locking unit may be disposed on the front left side of the washing machine and the second locking unit may be disposed on the front right side of the washing machine.

The upper frame 110 may include an opening flange 120 having the opening 120*a* formed at an inner side thereof. The opening flange 120 will be fully described below. The locking unit may be configured to (suitable for, capable of, adapted to, arranged to, operable to, etc.) restrict the door when the door closes the opening 120*a* and may be provided at an inner side of the upper frame 110 to correspond to a side surface of the door, and a front of the opening flange 120 may be formed to be flat.

In the case in which the locking unit 70 is disposed at a front surface of the door 40 which is opposite to the rotational shaft of the door 40, when a user leans into the cabinet 100 to put the laundry in or take the laundry out, the user may be pressed by the locking unit 70 which protrudes more than an adjacent surface, and thus may have inconvenience.

To this end, an embodiment of the disclosure improves the structure so that the locking unit 70 restricts the side surfaces of the door 40, and thus the front surface of the door 40, i.e., the front of the opening flange 120 are maintained to be flat. Therefore, the convenience in putting the laundry in or taking the laundry out may be provided. Further, since part of the front of the opening flange 120 is prevented from protruding, the opening 120*a* may be formed to be wider.

The front shape of the opening flange 120 is not limited to examples provided in the disclosure herein. The front shape of the opening flange 120 may have other shapes, the front shape of the opening flange 120 being sufficient as long as the front shape of the opening flange 120 is provided to coincide with a front shape of the door 40. In an embodiment of the disclosure, the front shape of the opening flange 120 and the front shape of the door 40 may be formed to be flat, such that the front of the door 40 corresponds to the front of the opening flange 120 when the door 40 is closed.

Figure 5:
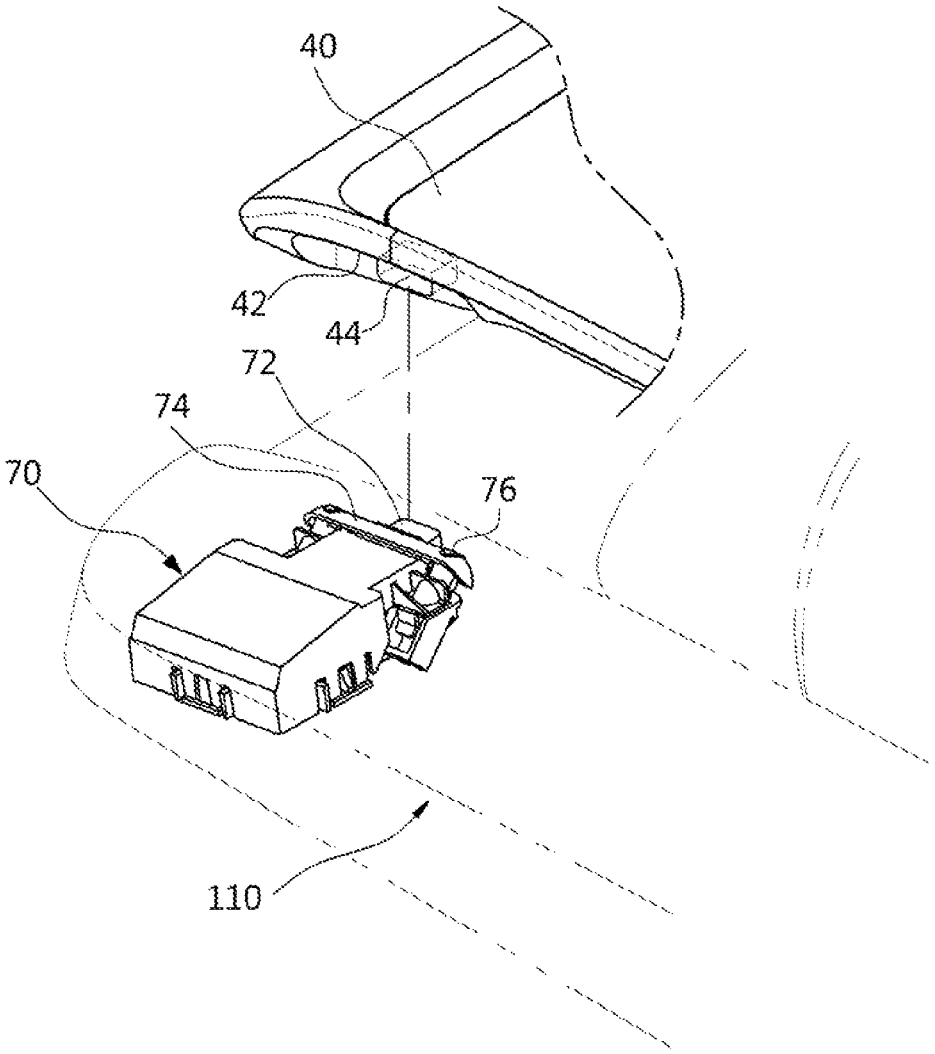
FIG. 5 is a perspective view of a locking unit of the washing machine in accordance with an embodiment of the disclosure.
Figure 6:
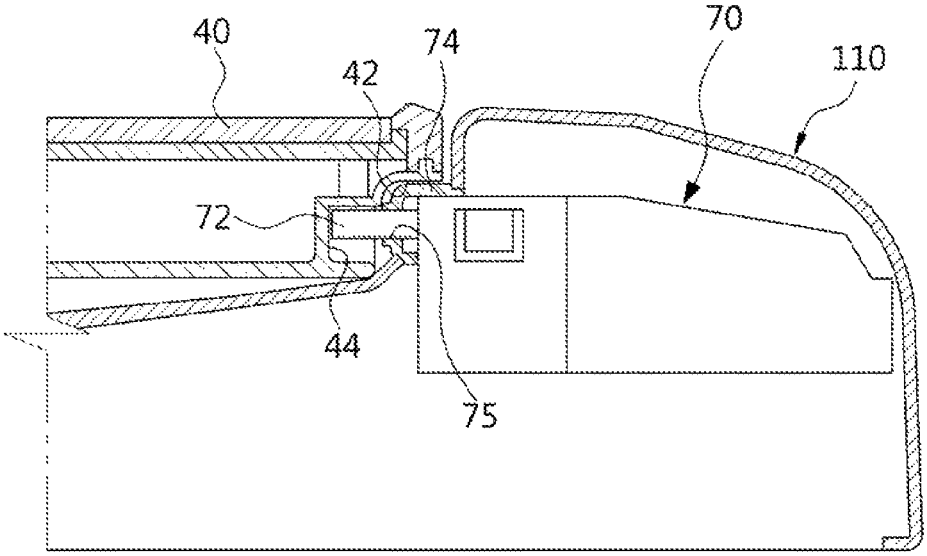
FIG. 6 is a cross-sectional view of the locking unit of the washing machine in accordance with an embodiment of the disclosure.

FIG. 5 is a perspective view of the locking unit of the washing machine in accordance with an embodiment of the disclosure, and FIG. 6 is a cross-sectional view of the locking unit of the washing machine in accordance with an embodiment of the disclosure.

The locking unit may include a sliding member 72.

The sliding member 72 may be disposed to correspond to the side surface of the door 40 and thus to restrict the door 40 through a sliding movement when the door 40 closes the opening 120*a*. Specifically, a groove-shaped fixing groove 44 may be provided at the side surface of the door 40 so that the sliding member 72 is inserted into the fixing groove 44 to restrict the door 40.

The sliding member 72 may be disposed to correspond to at least one of the side surfaces of the door 40 and thus to restrict the door 40. One pair of sliding members 72 may be disposed to correspond to the both side surfaces of the door 40, and a door opening and closing detection sensor 76 to be described later and the sliding member 72 may be respectively disposed together.

The shape of the sliding member 72 is not limited to the example embodiments disclosed herein. However, in an embodiment of the disclosure, upper and lower surfaces of the sliding member 72 may be formed to be wider than side surfaces of the sliding member 72. That is, the sliding member 72 may be provided to extend along a lengthwise direction of the door 40 (longitudinally) when the door 40 closes the opening 120*a*.

In other words, assuming that the lengthwise direction of the door corresponds to a radial direction with respect to rotation of the door is a first direction, the sliding member 72 may be formed along the first direction W1 longitudinally. Thus, the fixing groove 44 may be correspondingly formed to extend along the first direction W1. Since the sliding member 72 may be formed in the first direction W1 which is the lengthwise direction of the door 40, the door 40 may be more firmly restricted. The sliding member 72 and fixing groove 44 may be formed longer in the first direction W1 (front to back or back to front direction) than in a direction corresponding to a widthwise (left to right or right to left direction) direction of the door (e.g., direction X2).

Assuming that the rotation shaft for the opening and closing of the door 40 is a first shaft X1, the sliding member 72 may be slid along a second shaft X2 parallel to the first shaft X1 in an axial direction and may selectively restrict the door 40. As the sliding member 72 makes a movement in the axial direction of the second shaft X2 at at least one side surface of the door 40, the door 40 may be more firmly restricted. That is, the sliding member 72 may move in the axial direction of the second shaft X2 at one side surface of the door 40 (e.g., the left side), and/or may move in the axial direction of the second shaft X2 at the other side surface of the door 40 (e.g., the right side).

The locking unit 70 may further include a mounting protrusion 74.

The mounting protrusion 74 may be disposed to correspond to the side surface of the door 40, to adjust the position of the door 40 when the door 40 closes the opening 120*a*, and to guide the door 40 so that the door 40 may be mounted on an exact position. Specifically, a mounting groove 42 formed to be more concave than the adjacent side surface of the door 40 may be provided at the side surface of the door 40, and the mounting protrusion 74 may be mounted in the mounting groove 42 to adjust the position of the door 40.

The shape of the mounting protrusion 74 is not limited to the example embodiments disclosed herein. In an embodiment of the disclosure, the mounting protrusion 74 may include a circular surface so that the door 40 may be hooked to the mounting protrusion 74 when the door 40 is closed and thus prevented from being not closed, and also the mounting groove 42 and the mounting protrusion 74 may be in contact with each other.

The mounting protrusion 74 may be provided to correspond to the both sides surface of the door 40, and thus the position of the door 40 may be prevented from straying when the door 40 closes the opening 120*a*.

The sliding member 72 as described above may be provided on the mounting protrusion 74.

Specifically, a sliding rail 75 may be provided on the mounting protrusion 74 so that the sliding member 72 is moved thereon, and thus the sliding member 72 may be moved along the sliding rail 75.

As the sliding member 72 may be provided on the mounting protrusion 74, the fixing groove 44 may be provided on the mounting groove 42. That is, the fixing groove 44 may be formed to be more concave inwardly to the door 40 than the mounting groove 42. When the sliding member 72 is provided on the mounting protrusion 74, the door 40 may be restricted after the position of the door 40 is adjusted, and thus it is more efficient to close the opening 120*a*. Further, the generation of an error due to shaking of the door 40 may be reduced, and thus the sliding member 72 may be easily inserted into the fixing groove 44.

For example, assume that the lengthwise direction of the door corresponds to the radial direction with respect to rotation of the door and is referred to as the first direction W1. For example, the mounting protrusion 74 may be formed in the first direction W1. Therefore, the mounting groove 42 may also be formed in the first direction W1. Here, the first direction W1 may be perpendicular to the directions X1 and X2 as shown in FIG. 3.

As the mounting protrusion 74 may be formed in the first direction W1 which is the lengthwise direction of the door 40, the door 40 may be further stably mounted thereon.

The locking unit 70 may further include the door opening and closing detection sensor 76.

In the case in which the closing operation is not perfectly performed when the door 40 closes the opening 120*a* and thus the opening 120*a* is maintained in an opened state, the door opening and closing detection sensor 76 may detect the state thereof (i.e., may detect the open state of the door 40 and opening 120*a*).

The sliding member 72 may be disposed at one or more side surfaces of the door 40 (e.g., a left side surface and a right side surface of the door 40), and the door opening and closing detection sensor 76 may be installed at the other side surface thereof.

That is, the sliding member 72 may be disposed at the cabinet 100 corresponding to the one side surface of the door 40, and the door opening and closing detection sensor 76 may be disposed at the cabinet 100 corresponding to the other side surface of the door 40. The sliding member 72 may also be disposed at both side surfaces of the door 40. A door opening and closing detection sensor 76 may also be disposed at the cabinet 100 corresponding to both side surfaces of the door 40. When the door opening and closing detection sensor 76 is provided, the case in which the closing operation of the door 40 is not perfectly performed may be detected and informed to a control part (not shown), and thus it is possible to sound alarms and/or stop the operation of the washing machine.

Figure 7:
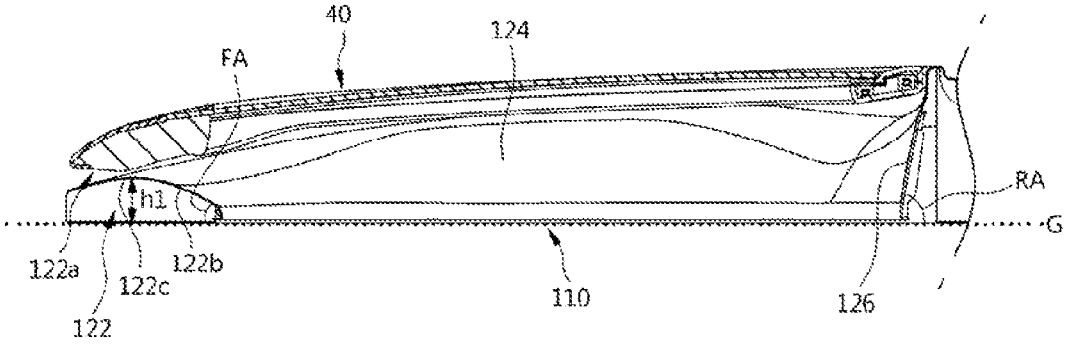
FIG. 7 is a cross-sectional view taken along line A-A' of FIG. 2.
Figure 8:
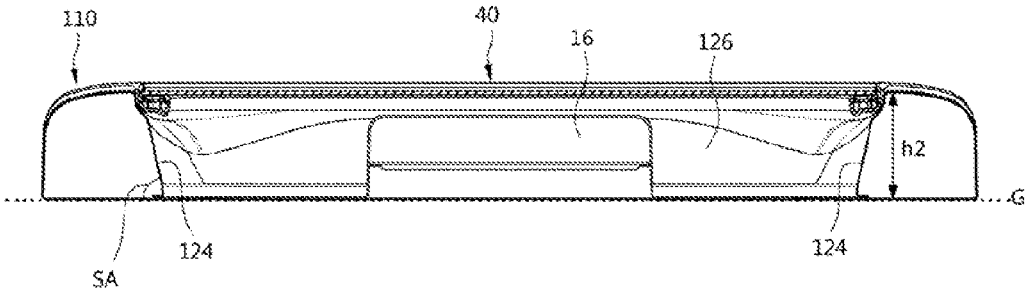
FIG. 8 is a cross-sectional view taken along line B-B' of FIG. 2.

FIG. 7 is a cross-sectional view taken along line A-A' of FIG. 2, and FIG. 8 is a cross-sectional view taken along line B-B' of FIG. 2.

The upper frame 110 may be provided on the lower frame 130, and may include the opening 120*a*.

The upper frame 110 may include the opening flange 120 configured to (suitable for, capable of, adapted to, arranged to, operable to, etc.) have the opening 120*a* formed at an inner side thereof and inclined toward the opening 120*a*.

The opening flange 120 may include a front flange 122 disposed at a front of the opening 120*a*, a pair of side flanges 124 disposed at both sides of the opening 120*a* to face each other, and a rear flange 126 disposed at a rear of the opening 120*a* to face the front flange 122 and connected with the pair of side flanges 124.

The front flange 122, the side flanges 124, and the rear flange 126 may be formed to enclose or surround the opening 120*a*.

As described above, the front flange 122 may be provided to provide convenience to the user when putting the laundry in or taking the laundry out.

That is, the locking unit 70 may be configured to (suitable for, capable of, adapted to, arranged to, operable to, etc.) restrict the door 40 and may be disposed at a side of the upper frame 110 to restrict the side surface of the door 40. Further, a button part 102 may be configured to (suitable for, capable of, adapted to, arranged to, operable to, etc.) input a control signal to the washing machine and may be disposed at a rear of the upper frame 110, and thus a structure of the front flange 122 may be simplified. One pair of the locking units 70 may be provided at both sides of the upper frame 110 to correspond to the both side surface of the door 40, and the front flange 122 may be disposed between the pair of locking units 70 to be mounted at one side of the door 40 (e.g., a front side of the door 40). The button part 102 may generally refer to an input unit which enables or allows a user to input a command to select a washing mode. The button part 102 may further include a display unit to display an operating state of the washing machine. For example, an array of buttons (and/or knobs) may be arranged on the button part 102 to allow the user to input a selected washing mode. The button part 102 may also include one or more other interface mechanisms to input a command (e.g., a switch, wireless controls, etc.) and may include a touch-screen. The display (which may also incorporate a touch-screen) may include a liquid crystal display (LCD), a light emitting diode (LED) display, an organic light emitting diode (OLED) display, active matrix organic light emitting diode (AMOLED), and the like.

The front flange 122 may be disposed to be lower than the locking unit 70. Formerly, the locking unit 70 configured to restrict the operation of the door 40 was provided at a front side of the opening 120*a* to correspond to the front of the door 40, and thus a height of the front side of the opening 120*a* was increased. However, in an embodiment of the disclosure, since the locking unit 70 may be disposed at the side surface of the door 40, a height of the front flange 122 may be lowered. Since the locking unit 70 restricts the side surface of the door 40, the front flange 122 may be disposed to be lower than the locking unit 70, unlike in a conventional method in which the locking unit 70 is disposed at the front side of the opening 120*a*, such that a lower portion of one side of the door 40 is mounted thereon.

The front flange 122 may be provided at the front side of the opening 120*a* to form a curved surface which is upwardly convex. That is, the locking unit 70 and the button part 102 may not be disposed at the front flange 122, but may be disposed at the side and rear of the upper frame 110, respectively. Thus, it may be possible to simplify the configuration or arrangement of the front flange 122 and also to form a smooth curved surface.

The front flange 122 may be formed to have a gentler (shallower, less steep) slope than those of the side flanges 124 and the rear flange 126. Since the front flange 122 has the gentle slope, the user may lean into the rotating tub 12 and thus put the laundry in and take the laundry out with more convenience and ease.

The front flange 122 may include a front inclined surface 122*a* directed to the front side of the washing machine, a rear inclined surface 122*b* directed to the opening 120*a*, and a door mounting portion 122*c* formed between the front inclined surface 122*a* and the rear inclined surface 122*b* to be in contact with one side of the door 40 (a bottom, lower surface) when the door 40 is closed. In an embodiment of the disclosure, the door mounting portion 122*c* may be provided so that the one side of the door 40 is mounted thereon. However, the disclosure is not limited thereto, and the one side of the door 40 (e.g., a bottom, lower surface) may be mounted on the front inclined surface 122*a* or the rear inclined surface 122*b*.

The front inclined surface 122*a*, the rear inclined surface 122*b*, and the door mounting portion 122*c* may be formed as one curved surface. When the front flange 122 is formed forward and backward in the one curved surface, the user may easily lean and access into the rotating tub 12.

For example, assume that an angle between the side flanges 124 and a bottom surface G is a side angle SA, and an angle between the rear flange 126 and the bottom surface G is a rear angle RA, then an angle between the front inclined surface 122*a* and the bottom surface G may be formed to have a front angle FA which is gentler (e.g., shallower, smaller, less steep, etc.) than the side angle SA and/or the rear angle RA. That is, the front angle FA may be formed to be smaller than the side angle SA and/or the rear angle RA. In other words, the opening flange 120 may be formed so that a slope thereof is gradually changed from the side or the rear side of the opening 120*a* toward the front side thereof in a circumferential direction of the opening 120*a*. The bottom surface G may correspond to an imaginary horizontal plane parallel to a ground plane (e.g., parallel to a bottom surface of the cabinet).

The door mounting portion 122*c* may be disposed at a portion in which the front inclined surface 122*a* and the rear inclined surface 122*b* of the front flange 122 are in contact with each other (meet). The door mounting portion 122*c* may be disposed at the other side of a portion in which the door 40 is rotated, such that the other side may be mounted. If the door 40 closes the opening 120*a* and one side of the door 40 is mounted on the door mounting portion 122*c*, the locking unit 70 may be provided at one or more side surfaces of the door 40 to restrict the door 40.

At least one mounting pad 128 may be provided at the door 40 to prevent generation of a noise or shock when the door 40 is opened or closed. For example, as shown in FIG. 3, a mounting pad 128 may be disposed in one or more corners of a bottom surface of the door 40 (e.g., a front left corner, a front right corner). One or more mounting pads 128 may also be disposed at other locations of the door (e.g., along one or more sides of the bottom surface of the door 40).

The upper portion of the opening flange 120 may be formed to be gradually inclined from the rear side thereof toward the front side thereof. That is, the front flange 122 may be formed to have a lower height from the bottom surface G than that of the side flanges 124 or the rear flange 126, so that the user may easily access into the washing machine.

That is, assuming that a height from the bottom surface G of the upper frame 110 to the upper portion of the front flange 122 is h1, the height h1 may be formed to be lower than a height h2 from the bottom surface G to a certain point of the side flange 124 (e.g., a center of the side flange 124, a tallest point of the side flange 124, etc.). The bottom surface G may correspond to a virtual surface used as a reference of the heights h1 and h2 from the lower portion of the upper frame 110. The height h1 is not limited to the example embodiments disclosed herein. Formerly, since the locking unit configured to restrict the operation of the door 40 may be provided at the front flange 122, the height h1 has to be bigger. However, in an embodiment of the disclosure, since the locking unit 70 is disposed at one or more side surfaces of the door 40, the height of the front flange 122 may be reduced. In an embodiment of the disclosure, the height h1 may be approximately 26 mm and may be less than approximately 26 mm.

Since the washing machine of the disclosure has the improved door locking unit, the door may be prevented from being opened undesirably, and thus the door may be effectively restricted.

Further, since the cabinet structure is improved, the user can easily access in the washing machine.

As shown in the drawings, the door 40 may be rotatable about a rotation shaft which is disposed along the X1 direction. However, the disclosure is not limited to this example embodiment. For example, in an alternative embodiment, the door 40 may be rotatable about a rotation shaft which is disposed along a different direction, and the one or more locking units may be arranged to be located on side surfaces which correspond to the disposition of the door. For example, the door 40 may be rotatable about a rotation shaft which is disposed in the front left corner of the washing machine at one end, and the back left corner of the washing machine at the other end. Thus, the one or more locking units may be disposed adjacent to the front right corner of the washing machine, and/or the back right corner of the washing machine at the other end, according to how the door is closed.

Although example embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. A washing machine comprising:

a cabinet having an opening and an opening flange formed around the opening;

a door rotatably provided to open and close the opening of the cabinet, the door comprising:

a concave mounting groove provided on a side surface of the door, and a fixing groove provided at the side surface of the door;

a tub provided in the cabinet;

a door detection sensor configured to detect the opening and the closing of the door; and a locking unit disposed at the cabinet to correspond to the side surface of the door and configured to selectively restrict an operation of the door while the door detection sensor detects the door as being closed, the locking unit comprising:

a sliding member configured to slide in a direction parallel to a rotating axis of the door to be inserted into the fixing groove of the side surface of the door to restrict the opening of the door while the door detection sensor detects the door as being closed, and a mounting protrusion disposed at the cabinet, the mounting protrusion configured to be mounted in the concave mounting groove to adjust a position of the door as the door closes, thereby reducing an error when the sliding member slides to be inserted into the fixing groove to restrict the operation of the door while the door detection sensor detects the door as being closed, wherein the opening flange comprises a front flange disposed around the locking unit at a front side of the opening of the cabinet so that a side of the door is mounted thereon.

2. The washing machine according to claim 1, wherein the opening flange further comprises:

a pair of side flanges formed at side surfaces of the opening of the cabinet to face each other; and a rear flange provided at an opposite side to the front flange and connected with the pair of side flanges, and the front flange is formed to have a shallower slope than the pair of the side flanges and the rear flange.

3. The washing machine according to claim 2, wherein the front flange comprises:

a front inclined surface inclined downward toward a front side of the cabinet;

a rear inclined surface inclined downward toward the opening of the cabinet; and a door mounting portion formed between the front inclined surface and the rear inclined surface so that one side of the door is mounted thereon when the door is closed.

4. The washing machine according to claim 3, wherein, an angle formed between the front inclined surface and a bottom surface is smaller than a side angle which corresponds to an angle formed between one of the pair of the side flanges and the bottom surface.

5. The washing machine according to claim 3, wherein at least one of the front inclined surface, the rear inclined surface, and the door mounting portion is formed as a curved surface.

6. The washing machine according to claim 1, wherein an upper portion of the opening flange is formed to be inclined downward from a rear thereof toward a front thereof.

7. The washing machine according to claim 1, wherein:

the opening flange further comprises a pair of side flanges formed at side surfaces of the opening of the cabinet to face each other; and the cabinet comprises:

a lower frame in which the tub is disposed; and an upper frame disposed on the lower frame to include the opening of the cabinet and the opening flange, and in the opening flange, a height h1 which corresponds to a height from a bottom surface of the upper frame to the front flange, is less than a height h2 which corresponds to a height from the bottom surface to an upper portion of the side flange.

8. The washing machine according to claim 3, wherein the locking unit selectively restricts the door at the side surface of the door when the door is in contact with the door mounting portion.

9. The washing machine according to claim 1, wherein the front flange is disposed to be lower than the locking unit.

10. A washing machine comprising:

a cabinet having an opening;

a door to open and close the opening of the cabinet, the door comprising:

a concave mounting groove provided at a side surface of the door, and a fixing groove provided at the side surface of the door;

a tub provided in the cabinet;

a door detection sensor configured to detect the opening and the closing of the door; and a locking unit disposed at the cabinet configured to selectively restrict an operation of the door while the door detection sensor detects the door as being closed, the locking unit comprising:

a sliding member configured to slide in a direction parallel to a rotating axis of the door to be inserted into the fixing groove of the side surface of the door to restrict the opening of the door while the door detection sensor detects the door as being closed, and a mounting protrusion disposed at the cabinet, the mounting protrusion configured to be mounted in the concave mounting groove to adjust a position of the door as the door closes, thereby reducing an error when the sliding member slides to be inserted into the fixing groove to restrict the operation of the door while the door detection sensor detects the door as being closed.

11. The washing machine according to claim 10, wherein the locking unit and an additional locking unit are disposed at the cabinet and provided as the locking unit to correspond to the side surface of the door and another side surface of the door respectively.

12. The washing machine according to claim 10, wherein, the mounting protrusion extends longitudinally in a lengthwise direction of the door, which corresponds to a radial direction with respect to rotation of the door, to correspond to the mounting groove.

13. The washing machine according to claim 11, wherein, a sliding member of the additional locking unit extends longitudinally in a lengthwise direction of the door, which corresponds to a radial direction with respect to rotation of the door.

14. The washing machine according to claim 10, wherein the sliding member is provided on the mounting protrusion.

15. The washing machine according to claim 10, wherein the door detection sensor is disposed at the cabinet to correspond to the of side surface of the door, to detect opening and closing of the door.

16. The washing machine according to claim 10, wherein the cabinet comprises an opening flange formed around the opening of the cabinet so that a slope of the opening flange is gradually changed from a side of the opening toward a front side thereof in a circumferential direction of the opening of the cabinet.

17. A washing machine comprising:

a cabinet having an opening and an opening flange formed around the opening of the cabinet;

a door to open and close the opening of the cabinet, the door comprising:

a mounting groove provided at a side surface of the door, and a fixing groove provided at the side surface of the door;

a tub provided in the cabinet;

a door detection sensor configured to detect the opening and the closing of the door; and a locking unit disposed at the cabinet to correspond to the side surface of the door and configured to selectively restrict an operation of the door while the door detection sensor detects the door as being closed, the locking unit comprising:

a sliding member configured to slide in a direction parallel to a rotating axis of the door to be inserted into the fixing groove of the side surface of the door to restrict the opening of the door as the door detection sensor detects the door as being closed, and a mounting protrusion disposed at the cabinet, the mounting protrusion configured to be mounted in the mounting groove to adjust a position of the door as the door closes, thereby reducing an error when the sliding member slides to be inserted into the fixing groove to restrict the opening of the door while the door detection sensor detects the door as being closed, wherein the opening flange is provided to correspond to a front surface of the door and a front portion of the opening flange is formed to have an upwardly convex curved surface.

18. The washing machine according to claim 17, wherein the mounting groove is formed to be more concave than an adjacent side surface of the door.

19. A washing machine comprising:

a cabinet having an opening;

a door to open and close the opening of the cabinet, the door comprising:

a concave mounting groove provided on a side surface of the door, and a fixing groove provided at the side surface of the door;

a tub provided in the cabinet;

a door detection sensor configured to detect the opening and the closing of the door;

a locking unit disposed at the cabinet to correspond to the side surface of the door and configured to selectively restrict an operation of the door while the door detection sensor detects that the door is closed, the locking unit comprising:

a sliding member configured to slide in a direction parallel to a rotating axis of the door to be inserted into the fixing groove of the side surface of the door to restrict the opening of the door while the door detection sensor detects the door as being closed, and a mounting protrusion disposed at the cabinet, the mounting protrusion configured to be mounted in the concave mounting groove to adjust a position of the door as the door closes, thereby reducing an error when the sliding member slides to be inserted into the fixing groove to restrict the operation of the door while the door detection sensor detects the door as being closed; and a front flange disposed between a front side of the cabinet and a front side of the opening of the cabinet and between the locking unit and an additional locking unit, the front flange including a front portion inclined downward toward the front side of the cabinet, a rear portion inclined downward toward the front side of the opening of the cabinet, and a center portion formed to have an upwardly convex curved surface which connects the front portion and the rear portion.

20. The washing machine according to claim 19, wherein the fixing groove extends further into the side surface of the door than the mounting groove.

21. The washing machine according to claim 19, further comprising a rear flange provided at an opposite side to the front flange, wherein:

an angle formed between a front inclined surface of the front flange and a bottom surface is smaller than a rear angle which corresponds to an angle formed between the rear flange and the bottom surface.

* * * * *